United States Patent [19]

Brazier

[11] 4,185,354

[45] Jan. 29, 1980

[54] APPARATUS FOR CLEANING FLOORS, CARPETS AND THE LIKE

[75] Inventor: Alan J. Brazier, Alvechurch, England

[73] Assignee: Vax Appliances Limited, Bromsgrove, England

[21] Appl. No.: 905,417

[22] Filed: May 12, 1978

[30] Foreign Application Priority Data

May 13, 1977 [GB] United Kingdom ..... 20152/77
Nov. 5, 1977 [GB] United Kingdom ..... 46144/77

[51] Int. Cl.[2] ..... A47L 7/00

[52] U.S. Cl. ..... 15/321; 15/328; 15/353

[58] Field of Search ..... 15/320, 321, 322, 328, 15/353

[56] References Cited

U.S. PATENT DOCUMENTS

| | | | |
|---|---|---|---|
| 1,982,345 | 11/1934 | Kirby | 15/321 |
| 2,643,732 | 6/1953 | Keen | 15/321 X |
| 3,180,071 | 4/1965 | Nolte | 15/328 |
| 3,343,199 | 9/1967 | Nolte | 15/353 X |
| 3,616,482 | 11/1971 | Brycki | 15/322 |
| 3,720,977 | 3/1973 | Brycki | 15/353 |

FOREIGN PATENT DOCUMENTS

| | | | |
|---|---|---|---|
| 591255 | 7/1925 | France | 15/321 |
| 1288763 | 9/1972 | United Kingdom . | |

*Primary Examiner*—Peter Feldman
*Attorney, Agent, or Firm*—Claude A. S. Hamrick

[57] ABSTRACT

A suction head for a suction cleaning appliance with means for delivering a cleaning liquid for application to a surface to be cleaned and collecting the delivered liquid from said surface having a liquid delivery duct disposed within an inner compartment itself arranged within a suction chamber. The duct is provided with fine holes whereby the liquid is delivered in a dropwise manner. The inner compartment and the suction chamber have smooth mouths arranged in a common plane so that the liquid delivered through the holes is constrained to contact the surface being cleaned before encountering air flow over that surface induced by suction in the suction chamber.

10 Claims, 12 Drawing Figures

101
Y
X
113
107
112
111
110
109
108
100
102
119
101
X
Y 101
102
108
107
113
114
118
103
108

77
105
104
106
102
107
108
117
116
115
118
116
112
108
119

APPARATUS FOR CLEANING FLOORS, CARPETS AND THE LIKE

REFERENCE TO RELATED APPLICATIONS

This application is related to subject matter disclosed in my copending applications, Ser. Nos. 957,212 and 957,408, filed on Nov. 3, 1978, and Ser. No. 905,396, filed on May 12, 1978, all of which are assigned to a common assignee.

BACKGROUND OF THE INVENTION

Field of the Invention

This invention relates to apparatus for cleaning floors, walls, carpets, curtains, upholstery and the like. It is an object of the invention to provide a dual purpose apparatus suitable for both dry suction cleaning and water extraction cleaning.

Many types of dry suction cleaning apparatus ("vacuum cleaners") are known and there have been a few proposals for combining such apparatus with shampooing apparatus, that is to say apparatus for generating a cleansing foam which is essentially dry in nature in that is requires only a relatively small quantity of water so that a carpet or the like treated in this way is scarcely wetted, but only dampened, the foam being sucked up by the vacuum cleaner which is then adapted to collect the relatively small quantity of liquid incorporated in the foam instead of the normal dry dust.

However, a more thorough cleaning process is that known as water extraction cleaning, in which a carpet or the like is thoroughly wetted by a solution containing a suitable cleansing agent, such as a non-foaming detergent, and the carpet or the like is then substantially dried by uptake of the solution by suitable suction apparatus.

SUMMARY OF THE INVENTION

According to the invention we provide a suction cleaning apparatus comprising a container adapted for the collection of a liquid having an inlet for connection with a cleaning head and detachable means for alternatively collecting dry dust, a motor driven air suction unit with an air inlet communicating with said container to apply suction thereto, a detachable reservoir for a cleaning liquid so as to enable the apparatus to be used alternatively for wet cleaning, a shut-off valve to register with said air inlet of the suction unit to close said air inlet in response to the level of the contents of the container, and valve means for alternatively delivering air from an exhaust outlet of the suction unit either to atmosphere or to the interior of said reservoir so as to deliver liquid from the reservoir to the cleaning head.

Thus, when the liquid reservoir is in position, the cleaner can be used for water extraction cleaning, the cleaning liquid being delivered to the cleaning head, which is preferably a separate member coupled to the container by means of the suction hose, and through which the cleaning liquid is extracted from the carpet or other material being cleaned immediately after its application thereto.

Alternately, the apparatus can be used for dry suction cleaning by removing the reservoir and fitting the means for collecting dry dust, which means may comprise a suitable filter unit so that the dry dust is collected directly in the container, but alternatively the container may be adapted to receive a dust bag in which the dust is collected.

The valve means preferably includes a valve member biased into a first position in which exhaust air from the suction unit is allowed to flow to atmosphere, the valve member being so arranged as to be engaged by a part carried by the reservoir when the latter is in use so that the valve member is then moved to a second position in which the exhaust air flow from the suction unit is diverted to the interior of the reservoir so as to apply a positive pressure therein.

If desired, a foam generating unit could be provided as an alternative to the liquid reservoir so that the apparatus could then perform the additional function of shampooing as well as dry vacuuming and water extraction cleaning.

BRIEF DESCRIPTION OF THE DRAWINGS

These and other features of the invention will now be described by way of example with reference to the accompanying drawings wherein.

DESCRIPTION OF THE PREFERRED EMBODIMENT

Figure 1:
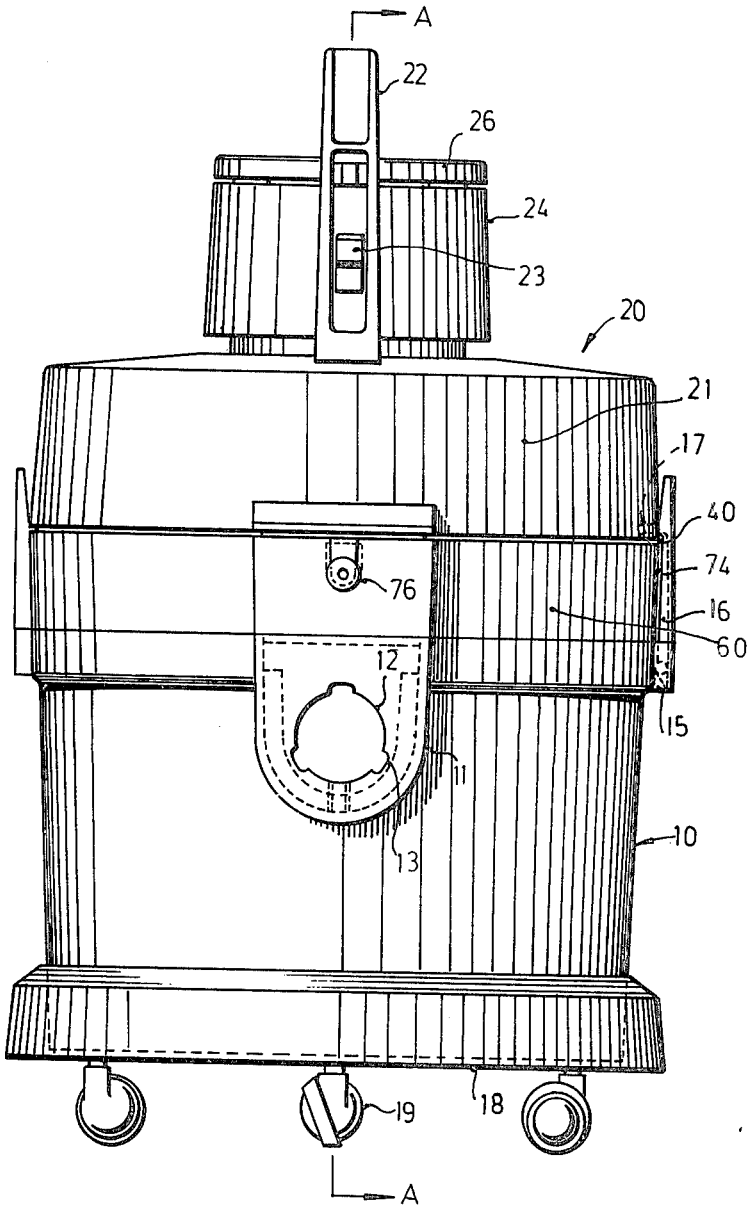
FIG. 1 shows a preferred embodiment of suction cleaning apparatus in front view and with a removable clean water reservoir in position.

The suction cleaner illustrated in the accompanying drawings includes a main container 10 having an open top closed by a top cover assembly 20 with the interposition of either a reservoir 60 if the cleaner is to be used for water extraction cleaning, or a dust filter assembly 90 if it is to be used for dry suction cleaning. An impeller driven by an electric motor for creating the suction is housed in the top cover assembly 20, together with a valve assembly whereby exhaust air from the impeller is directed to the interior of the reservoir when the latter is in use or alternatively allowed to escape to atmosphere when the reservoir is not in use.

The main container 10 is formed with a lateral protruberance 11 for the reception of an end fitting (not shown) of a suction hose. The protruberance 11 is formed, for this purpose, with a circular aperture 12 with recesses 13, and an opening 14 is formed opposite thereto in the upper portion of the side wall of the container 10 so that air, together with any dust or water entrained therein, enters from the hose directly into the interior of the container in a generally radial direction.

Figure 5:
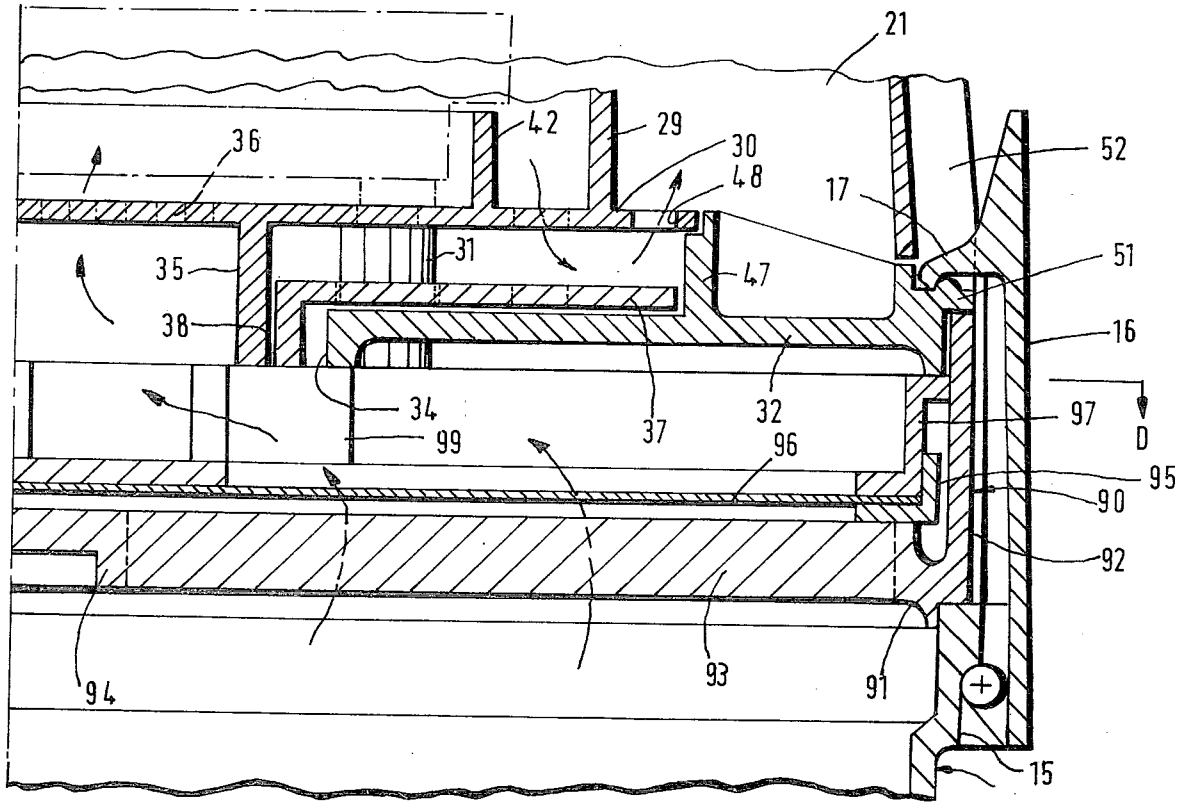
FIG. 5 is a fragmentary transverse section in a vertical plane perpendicular to that of FIG. 2 showing a dust filter assembly in place of the reservoir and exhaust air flow directed to atmosphere.
Figure 6:
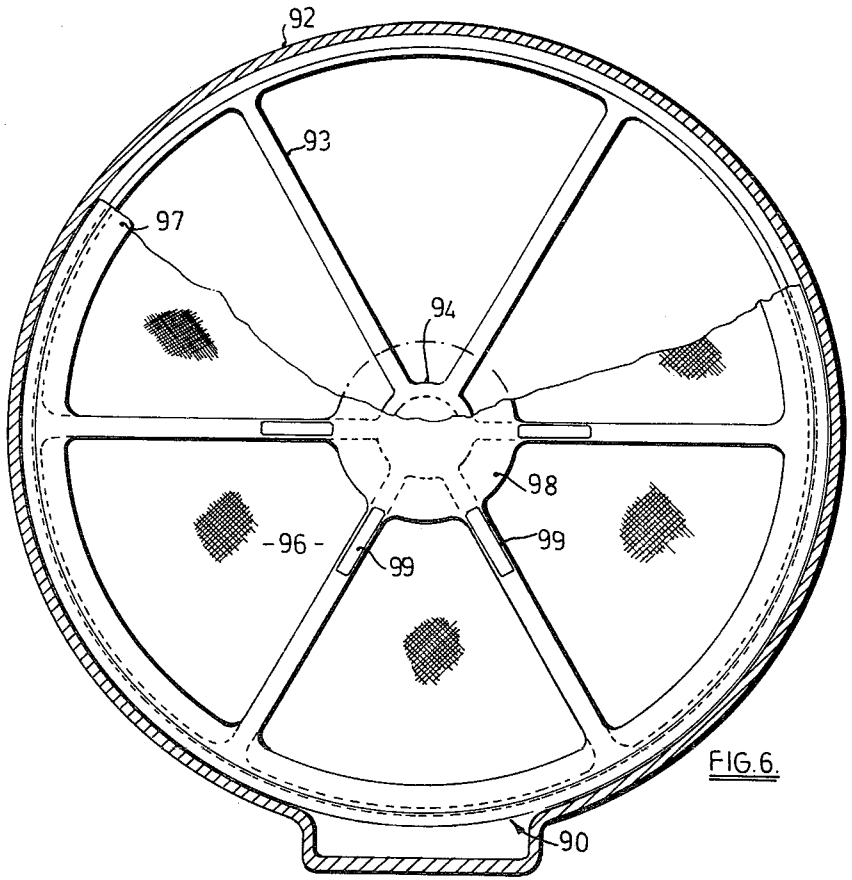
FIG. 6 shows a horizontal section on the line D—D of FIG. 5 (omitting the clips) with certain parts broken away to show the structure more clearly.
Figures 7, 8, 9:
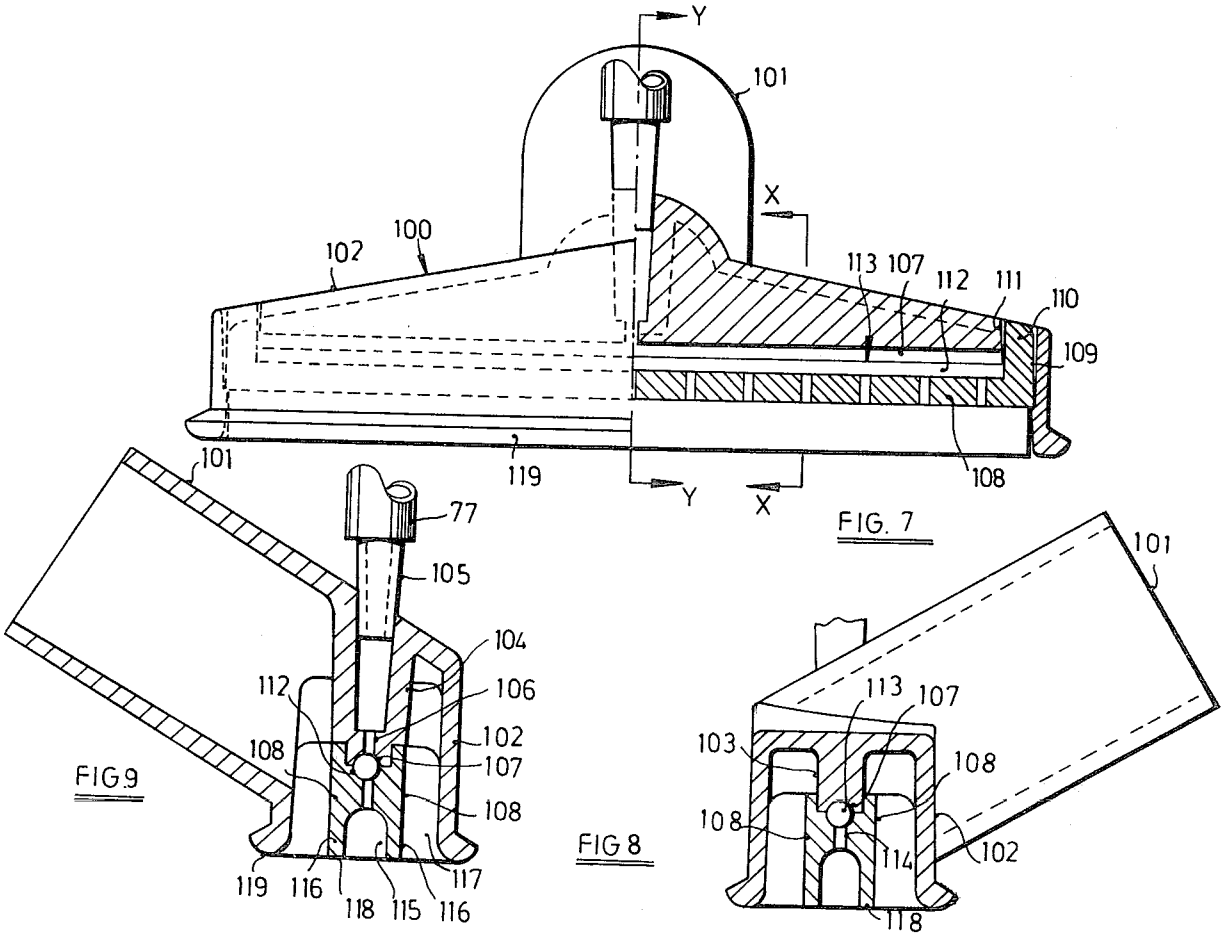
FIG. 7 is a half sectional front elevational view of a preferred embodiment of cleaning head.
FIG. 8 is a section on the line X—X of FIG. 7.
FIG. 9 is a section on the line Y—Y of FIG. 7.
Figure 10:
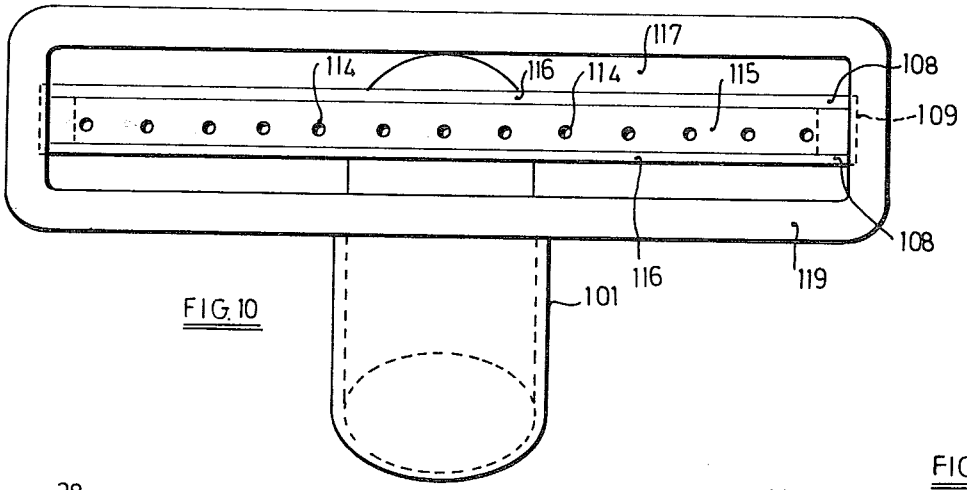
FIG. 10 is an underneath plan view corresponding to FIG. 7.

The main container 10 also carries a pair of diametrally spaced lugs 15 to which are pivoted retaining clips 16 each having a respective lip 17 for the purpose of securing the top cover assembly 20 and either the reservoir 60 as shown in FIGS. 1 to 4 or the dust filter assembly 90 as shown in FIGS. 5 and 6.

The main container 10 is provided with a mobile base 18 equipped with castors 19.

The top cover assembly 20 includes a main outer casing 21 having a carrying handle 22 centrally disposed thereon, and a switch 23 is mounted with the handle. A housing 24 beneath the handle 22 encloses the electric motor 25 and is covered by a ventilated top plate 26. The motor 25 is coupled to an impeller 27 which is located in a circular housing defined in combination by an annular wall 28 formed integrally with the main casing 21, and a similar annular wall 29 carried by a mounting plate 30. The latter is supported from a base plate 32 of the top cover assembly by means of studs 31 and an annular wall 47. The base plate 32, mounting plate 30 and annular wall 47 in combination define a valve chamber of a valve assembly indicated generally at 40 in FIG. 2.

The base plate 32 is itself supported by a peripheral downwardly directed rib 33 which seats within the outer wall of the reservoir 60 or the dust filter assembly 90. The plate affords a central aperture 34 which forms the outlet from the valve chamber, and a central ring 35 is formed beneath the mounting plate 30, and a plurality of holes 36 within the central region of the plate 30 form an inlet to an inlet chamber 43 which is bounded by an inner wall 42 and in which the intake of the impeller 27 is disposed, a sealing ring 41 surrounding the impeller intake.

A valve plate 37 is disposed within the valve chamber and is slidable over the studs 31 and carries a central ring 38 which is slidable over the ring 35.

The impeller 27 thus draws air in from beneath the top cover assembly 20 through the apertures 36 so as to create a partial vacuum beneath the cover assembly. The exhaust air from the impeller 27 is discharged into an annular chamber 44 defined by the walls 28 and 29 in combination. A ring of apertures 45 in the mounting plate 30 between the annular walls 29 and 42 allows the exhaust air to escape into the valve chamber through a corresponding ring of apertures 46 in the valve plate 37, the apertures 45 and 46 being in register with one another as can most clearly be seen in FIG. 3. When the valve plate 37 is in its raised position as illustrated in FIG. 2, the exhaust air from the fan is directed through the central aperture 34 of the base plate 32 and thus into the interior of the reservoir 60.

On the other hand, when the valve plate 37 is in its lower position as illustrated in FIG. 5, the aperture 34 is closed by the valve plate and air can only escape from the valve chamber through an outer ring of apertures 48 which are formed in the mounting plate 30 outside the annular wall 29. When the valve plate 37 is in its raised position, the apertures 48 are closed by the peripheral margin of the valve plate, but when the valve plate is in its lower position, exhaust air is thereby allowed to escape into the interior of the main casing 21 and thence through a gap 49 beneath the lower edge of the casing 21.

Figure 3:
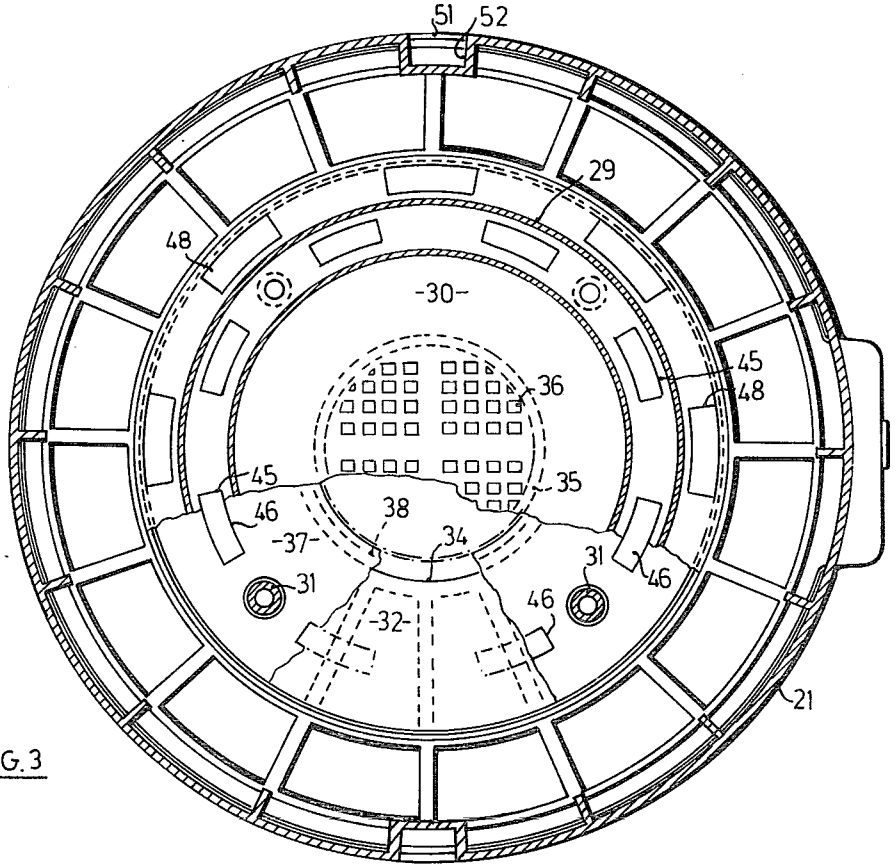
FIG. 3 shows a horizontal section on the line B—B of FIG. 2 with parts of a motor base plate and a valve plate broken away to show the internal construction of a valve assembly.
Figure 4:
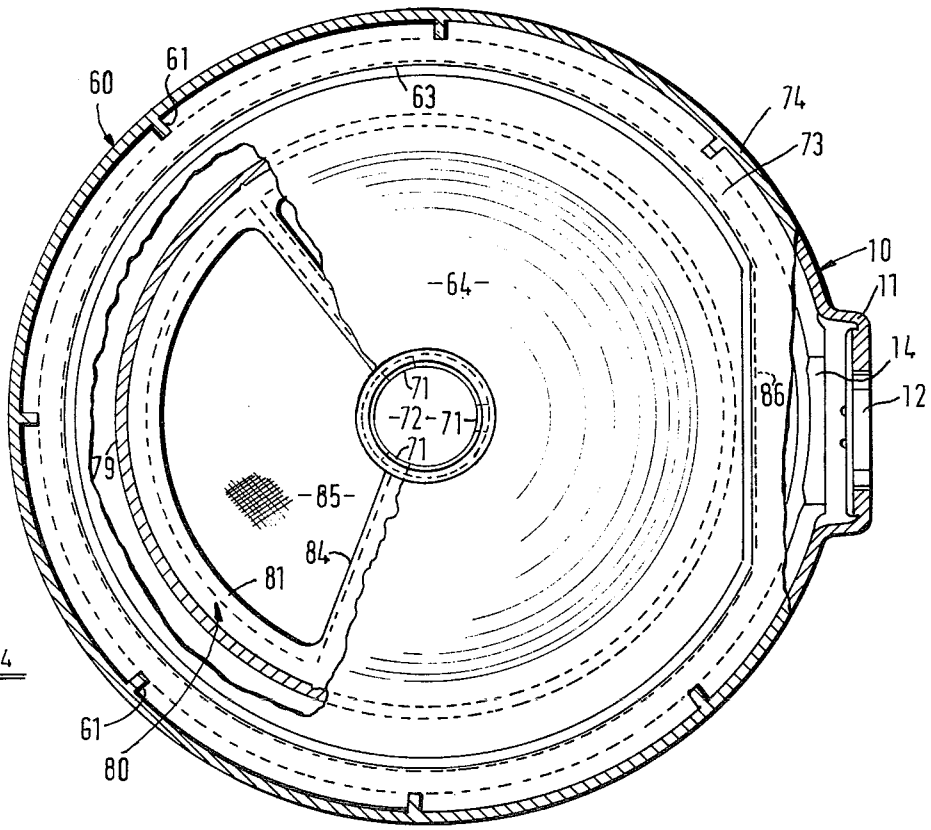
FIG. 4 shows a horizontal section on the line C—C of FIG. 2 with part of the reservoir broken away to show a liquid filter assembly.

The base plate 32 of the top cover assembly includes a pair of ears 51 which are engaged by the lips 17 of the clips 16, and the outer casing 21 is formed with recesses 52 to accept the retaining clips, as seen most clearly in FIGS. 3 and 5.

Figure 2:
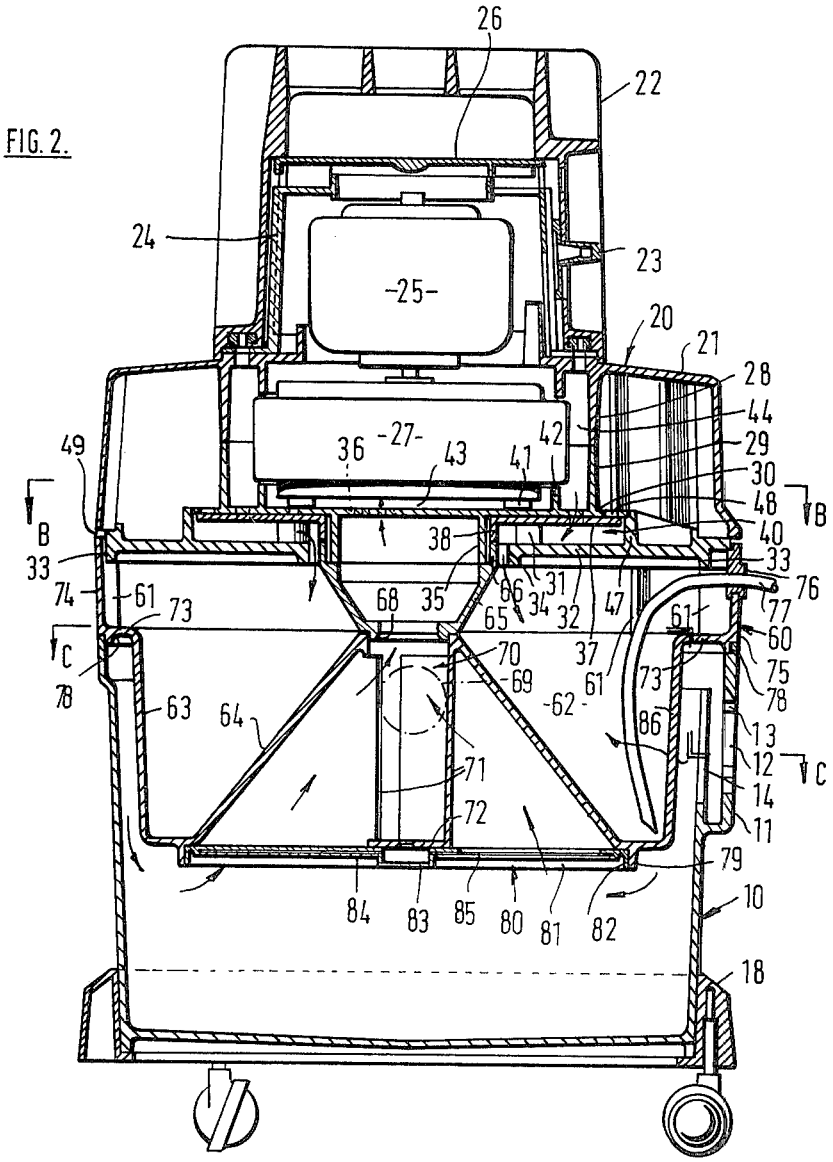
FIG. 2 shows a transverse section on the line A—A of FIG. 1.

The reservoir 60 includes an outer ring 74 which is interposed between the upper edge of the main container 10 and the lower edge of the top cover assembly 20, as shown in FIGS. 1 and 2. A number of vertical ribs 61 are disposed within the ring 74 to support the base plate 32 of the top cover assembly by engagement with the rib 33 thereof. The outer ring 74 has an inwardly directed flange 73 which supports an integral annular trough 62 which is defined by a generally cylindrical outer wall 63 and a frusto-conical inner wall or cone 64. The cone 64 supports a boss 65 which terminates at its upper edge in a ring 66 which is so positioned to engage the ring 38 of the valve plate 37, so that when the reservoir 60 is interposed between the top cover assembly 20 and the main container 10, the valve plate 37 is automatically lifted into its raised position so as to close apertures 48 and open aperture 34 and thereby direct exhaust air from the impeller 27 into the interior of the reservoir. In this way, sufficient pressure is generated within the trough 62 to displace liquid therefrom through a pipe 77 which is secured by means of a clip 76 in the outer ring 74. It will be appreciated that the pressure generated within the reservoir in this way is relatively low, but it is adequate to initiate and maintain a siphoning action since this is all that will be necessary when the appliance is used for cleaning carpets or other floor coverings. However, providing leakages of air are minimised by ensuring that the various components have an accurate fit with one another, it is possible to obtain sufficient pressure to raise liquid from the reservoir through a height of 2 meters or so, sufficient for the purpose of cleaning upholstery and curtains for example.

The boss 65 serves to place the inlet chamber 43 of the impeller 27 in communication with the main container 10 beneath the reservoir 60. In this way, suction is applied to a hose (not shown) connected to the main container 10 by means of the aperture 12.

To facilitate separation of entrained liquid droplets from the incoming air, the air flow is arranged to impinge directly on a flat face 86 afforded by the outer wall 63 of the trough 62. In this way, the incoming air tends to spread out in all directions and the sudden change in direction of flow when the air impinges on the flat face 86 assists in separation of the liquid droplets which collect on the outer face of the wall 63 and drain down so as to collect on a flange 79 formed at the underside of the trough and then drip into the body of the main container 10.

The arrangement whereby the incoming air from the suction hose enters the main container 10 substantially radially and flows in opposite directions around the side wall 63 of the trough 62 serves largely to prevent a swirling action and the establishment of a vortex in a manner which would tend to generate foam on the surface of liquid collected within the container 10.

In order to further to reduce the generation of such foam, a liquid filter assembly 80 is positioned beneath the cone 64. A ring 81 is formed with a flange 82 which fits tightly within the flange 79, and a central boss 83 is supported by radial ribs 84 which have a nylon mesh filter 85 moulded integrally. The filter 85 substantially eliminates the risk of a vortex being created as air is sucked up within the cone 64. Additionally, the size of the apertures defined by the mesh can be so chosen as to prevent the passage of foam.

For this purpose, the holes defined by the mesh may typically have a maximum dimension of about 0.15 mm and preferably as little as 0.02 mm.

In order to prevent liquid being sucked up into the impeller 27 if the capacity of the main container is exceeded, an overflow valve 70 is provided. This consists of a spherical float 69 confined between three guides 71 which extend downwardly from the centre of the cone 64 and carry at their lower ends a disc 72 which engages the central boss 83 of the filter assembly 80 to prevent the latter from being lifted by the suction applied thereto. The boss 65 carried by the cone 64 is formed with a seating 68 against which the float 69 will engage sealingly so as to prevent the passage of water upwardly into the intake chamber 43. In the illustrated embodiment, the float 69 is made of thin plastics material so as to be capable of being lifted solely by air flow. In practice, if the level of liquid in the container 10 rises to such a height that it enters the space beneath the cone 64, and thus lifts the float 69 towards the seating 68, the flow of air which continuous to be drawn beneath the trough 62 will eventually lift the float up to seating 68 before the water level reaches the lower edge of the hose inlet aperture 12.

The float valve 70 also serves to prevent water from the container 10 entering the intake chamber 43 if the appliance is inadvertently tipped over.

The outer ring 74 of the reservoir 60 is formed with an extension 75 which is aligned with the protruberance 11 of the main container 10 and supports the pipe clip 76. A rib 78 which extends around the entire periphery of the outer ring 74 and the extension 75 is adapted to seat within the open top of the container 10 as seen in FIG. 2.

When the appliance is to be used for dry suction cleaning, the reservoir 60 is removed and the dust filter assembly 90 is assembled between the main container 10 and the top cover assembly 20 and retained by means of the clips 16 as shown in FIG. 5.

The dust filter assembly 90 includes a support member 91 comprising an outer ring 92 with radialy ribs 93 supporting a central boss 94. An L-section ring 95 is seated within the ring 92 and supports the periphery of a fine mesh filter disc 96. The filter disc 96 is retained in position by means of an inner ring 97 which fits within the outer ring 92 and traps the peripheral portion of the disc as shown in FIG. 5. The inner ring 97 has a central plate 98 formed integrally therewith and radial ribs extending between the ring and the plate are formed with vertical spacer members 99 which engage the undersides of the ring 35 of the mounting plate 30 and of a rib around the aperture 34 of the base plate 32 of the top cover assembly 20 so as to prevent the filter lifting under the suction applied thereto.

In the absence of the boss 65 which forms part of the reservoir 60, the valve plate 37 drops to its lower position so as to close the aperture 34 and open the apertures 48.

In this way, dust entrained in the incoming air is filtered out and collected in the container 10. However, it will be appreciated that it would alternatively be possible for the top cover assembly 20 to be adapted for securing direct to the top of the main container 10, for example by forming on the casing 21 ears similar to the ears 51 for engagement by the lips 17 of the clips 16, a filter bag then being provided within the container 10 and having an adaptor for direct connection to the end of the hose adjacent to aperture 12.

The preferred form of cleaning head 100 for use with the appliance includes a tubular spigot 101 for attachment to the suction hose (not shown) and a transverse housing 102 with an internal transverse rib 103 and a central hollow boss 104 for reception of a nozzle 105 at the end of the pipe 77 through which liquid is supplied from the reservoir 60. A hole 106 is formed at the lower end of the boss and communicates with a channel 107 which extends along the underside of the transverse rib 103. A pair of mouldings 108 are located within the housing 102 by engaging at their ends in slots 109 formed in the ends of the housing. Additionally, the two mouldings in combination are shaped to afford a pair of vertical lugs 110 which fit within apertures 111 formed in the top wall of the housing adjacent the ends thereof. The two mouldings in combination also define a channel 112 which together with the channel 107 defines a transversely extending duct 113 whereby liquid received from the nozzle 105 through the hole 106 is distributed along the whole length of the housing 102.

Calibrated apertures 114 are provided at spaced intervals along the length of the head in order to regulate the flow of liquid so as to cause it to be delivered uniformly and continuously at an appropriate rate. Typically, the apertures 114 have a diameter of 0.4 mm and are spaced on 4 mm centres. Liquid then drips through these apertures and enters an inner compartment 115 defined between a pair of transversely extending walls 116 formed on the mouldings 108. The inner compartment 115 is disposed centrally of an outer compartment 117 defined by the casing 102, and the end faces 118 of the walls 116 are arranged so as to be flush with the mouth of the housing 102 as defined by a rounded bead 119. The bead is of continuous and uninterrupted form so that when passed over a pile fabric, the pile is not separated or combed. In this way the outer chamber 117 can be effectively sealed from the outside atmosphere so that a strong suction is applied to the fabric being cleaned. The arrangement of the end faces 118 of the walls 116 in the same plane as the mouth of the outer compartment 17 ensures that the inner compartment 115 is likewise effectively sealed against the fabric being treated and there is virtually no possibility of liquid being drawn from the inner compartment 115 directly to the outer compartment 117 by virtue of the air flow established within the head. Instead, the liquid is constrained to drip onto the fabric being cleaned. In this way, a thorough wetting of the fabric is ensured without spraying. This in turn, makes it possible for the appliance to operate with only a low pressure within the reservoir, and without any pump for the delivery of cleaning liquid to the head.

A shut-off valve (not shown) may be incorporated in the pipe 77 so as to enable the flow of cleaning liquid to the head to be interrupted.

Figure 11:
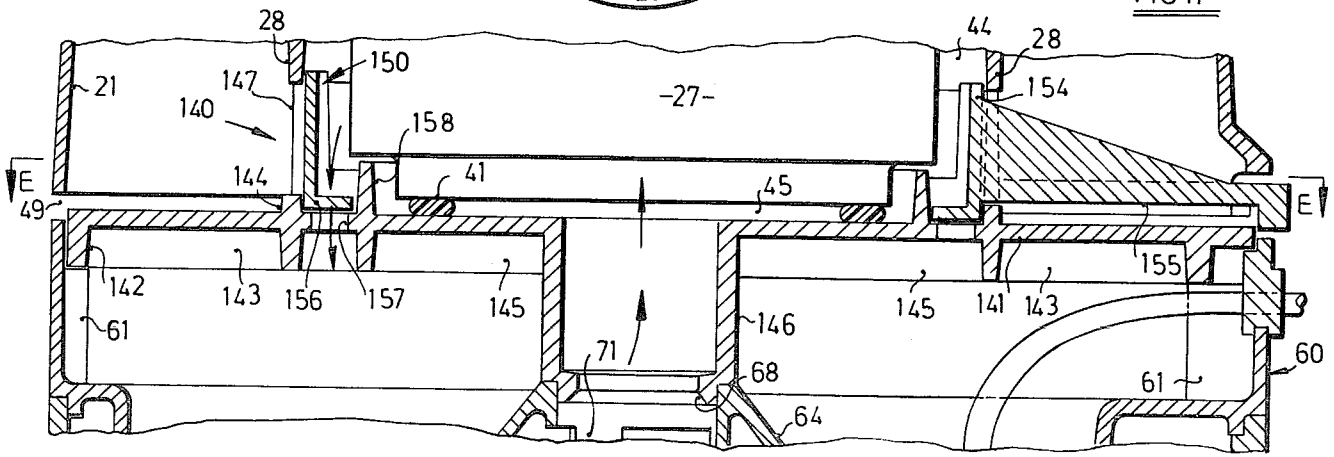
FIG. 11 shows a modified embodiment of the suction cleaner with a manual exhaust air flow valve in fragmentary transverse section similar to FIG. 5 but in a plane perpendicular thereto.

A similar control of liquid delivery can be achieved by the use of a manually operable valve for control of the exhaust air flow from the impeller 27, so as to enable such air to be directed to atmosphere when the reservoir is in position if it is desired to interrupt the supply of cleaning liquid. A modified valve assembly 140 for this purpose is illustrated in FIGS. 11 and 12 of the accompanying drawings.

The valve assembly 140 is incorporated at the underside of the top cover assembly 20 in place of the valve assembly 40 which is illustrated in FIGS. 2, 3 and 5. In this case, the cover assembly includes a base plate 141 having a peripheral rib 142 which engages within the outer ring 74 of the reservoir 60 or within the outer ring 92 of the dust filter assembly 90. The base plate 141 is formed with an annular wall 144 which in combination with the wall 28 of the casing 21 defines the exhaust outlet chamber 44 around the impeller 27. The base plate 141 is provided with reinforcing ribs 143 and 145 and a central boss 146 which affords the seating 68 for the float valve 70.

The annular wall 144 is formed as a series of tongues 147 spaced apart circumferentially by openings 148, with an elongated opening 149. A shutter 150 is provided within the annular wall 144 and this is formed as a cylinder 151 affording a series of tongues 152 separated circumferentially by openings 153, with an elongated tongue 154 to which a radial arm 155 is attached. The cylinder 151 also includes a number of inwardly projecting horizontal tongues 156, and the base plate 141 is formed with a ring of apertures 157 arranged between the annular wall 144 and an inner wall 158 which defines the intake chamber 43.

Figure 12:
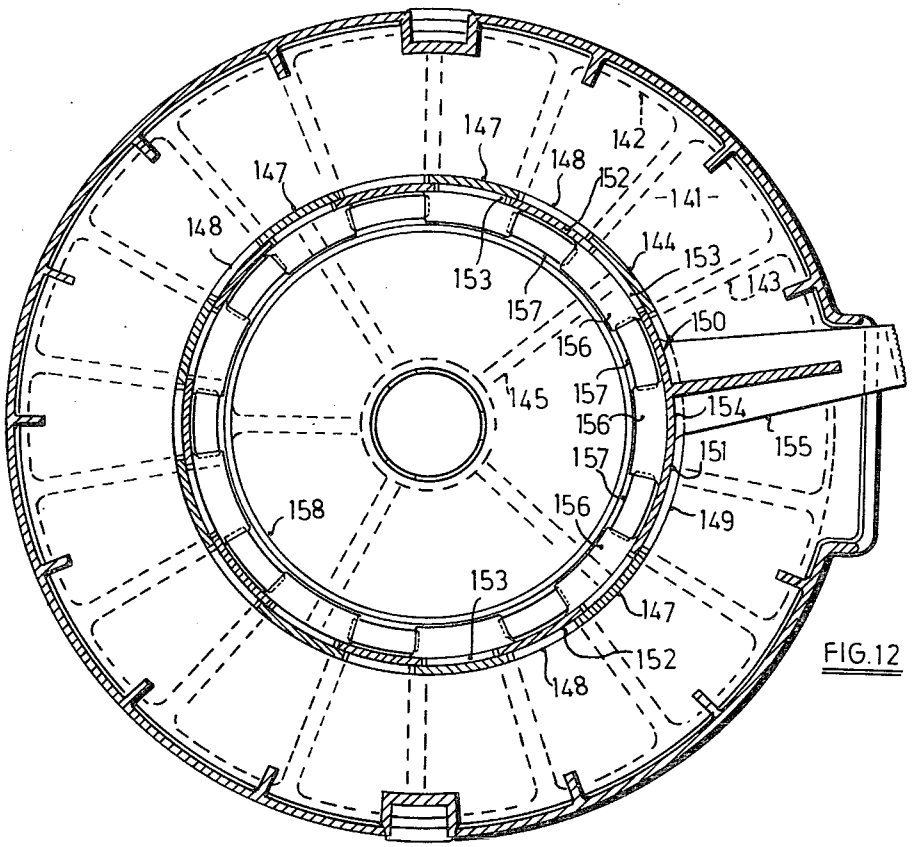
FIG. 12 shows a horizontal section on the line E—E of FIG. 11.

As can be seen from FIG. 12, the elongated tongue 154 is arranged in register with the elongated opening 149 so that the arm 155 projects outwardly through the elongated opening and terminates at a position outside the casing 21. In the position as shown in FIG. 12, the tongues 147 are in register with the openings 153 and the tongues 152 are in register with the openings 148, whilst the horizontal tongues 156 are disposed between the apertures 157. Thus, the exhaust air flow from the impeller 27 is confined within the chamber 44 and allowed to escape only through the apertures 157 to the underside of the base plate 141 so as to pressurise the interior of the reservoir 60 when this is assembled with the top cover assembly 20.

However, when the operating arm 155 is moved to the other end of the slot from which it protrudes through the casing 21, the tongues 147 and 152 are brought into register with one another so that the openings 148 and 153 are similarly brought into register with one another. This allows exhaust air to escape from the chamber 44 to the interior of the casing 21 and thence to the external atmosphere. At the same time the horizontal tongues 156 are brought into register with the apertures 157, and the air flow is prevented from entering the reservoir 60. Thus, the flow of liquid can be interrupted by operation of the arm 155, and indeed a degree of regulation may be obtained by intermediate settings of the operating arm 155.

Whilst the float 69 of the float valve 70 is shown in FIG. 2 as constrained by guides 71, it is alternatively possible to provide three or more internal vanes beneath the cone 64 of the reservoir 60, such vanes being of generally triangular shape so that their vertical edges serve as guides for the float 69. This arrangement has the advantage of further restricting the possibility of the establishment of a vortex beneath the cone 64, to such an extent that the filter assembly 80 could be omitted, although it is preferable to retain it because of its function as a screen substantially impervious to the passage of foam.

I claim:

1. Suction cleaning apparatus comprising:

(a) container means for the collection of both wet and dry matter and having an inlet for connection with a cleaning head;

(b) motor driven air suction means with an air exhaust outlet and an air inlet communicating with said container means for applying suction thereto;

(c) filter means for retaining dry matter within said container means so as to enable the apparatus to be used for dry suction cleaning;

(d) detachable reservoir means for storing cleaning liquid;

(e) delivery means for delivering said liquid to said cleaning head so as to enable the apparatus alternatively to be used for wet cleaning;

(f) said reservoir means and said filter means being interchangeably assembled with said container means and suction means so that the filter means is used in the absence of said reservoir means and vice versa;

(g) an air passageway in said reservoir means extending from the interior of said container means to the air inlet of said suction means, and a shut-off valve in association with said passageway to close the latter in response to the level of liquid collected in said container means; and (h) air-flow director means separate from said air passageway for directing air from said exhaust outlet of the suction unit alternatively to atmosphere when the filter means is in use or to the interior of the reservoir means when the latter is in use so as to displace liquid from the reservoir means to the cleaning head, while in either case suction from the suction outlet is simultaneously applied to the container means through said air passageway.

2. Suction cleaning apparatus according to claim 1 wherein the air flow direction means includes a valve member movable between a first position in which exhaust air from the suction means is allowed to flow to atmosphere and, a second position in which the exhaust air flow from the suction means is directed to the interior of the reservoir means so as to apply a positive pressure thereto, the reservoir means including a valve member engaging part which holds the valve member in said second position when the reservoir means is assembled with suction means.

3. Suction cleaning apparatus according to claim 2 wherein the valve member comprises a plate which is vertically movable in a valve chamber having an upper outlet communicating with the external atmosphere and a lower outlet communicating with the reservoir means, the valve plate being gravitationally biased to its first position so as to close the lower outlet unless raised to its second position by said part of the reservoir means.

4. Suction cleaning apparatus according to claim 1 wherein the container means comprises an open-topped vessel and the reservoir means is mounted across the open top of the container means and is itself open-topped, and the suction means is housed in a cover member which closes the open top of the reservoir means.

5. Suction cleaning apparatus according to claim 1 wherein the reservoir means comprises an annular trough which is received within the container means with and having an outer side wall disposed in spaced relation to the container which has an outer wall in which said inlet for connection to the cleaning head is disposed so that incoming air flow is directed substantially radially inwardly and directly onto the outer side wall of the trough.

6. Suction cleaning apparatus according to claim 5 wherein the outer side wall of the trough has a substantially vertical flat area in register with said inlet.

7. Suction cleaning apparatus according to claim 5 wherein said trough includes a generally cone shaped inner wall with a central opening through which air is drawn from the container means by said suction means, and a perforate screen is provided across the open underside of the cone.

8. Suction cleaning apparatus according to claim 7 wherein said shut-off valve means comprises a float valve and said central opening defines a seating for said float valve.

9. Suction cleaning apparatus according to claim 1 wherein the cleaning head comprises a suction chamber having means for connection to said container means and an open mouth, and an inner compartment arranged substantially centrally within the suction chamber and having side walls defining an open mouth in the plane of the open mouth of the suction chamber, the inner compartment having therein a cleaning-liquid delivery duct formed with a plurality of closely spaced fine outlets for substantially dropwise delivery of the liquid into the inner compartment at a position spaced from the mouth thereof.

10. Suction cleaning apparatus according to claim 1 wherein the air-flow director means includes a shutter movable between a first position in which exhaust air from the suction means is allowed to flow to atmosphere and, a second position in which the exhaust air flow from the suction means is directed to the interior of the reservoir means so as to apply a positive pressure thereto, the shutter having a manual operating member which is adjustable by the user to set the shutter in either of said first and second positions or in any intermediate position.

* * * * *